US006123784A

United States Patent [19]

Havette

[11] Patent Number: 6,123,784

[45] Date of Patent: Sep. 26, 2000

[54] AUSTENITIC STAINLESS STEEL ESPECIALLY FOR MAKING WIRE

[75] Inventor: Etienne Havette, Mercury, France

[73] Assignee: Ugine-Savoie Imphy, Ugine, France

[21] Appl. No.: 09/270,762

[22] Filed: Mar. 17, 1999

[30] Foreign Application Priority Data

Mar. 18, 1998 [FR] France ..... 98 03263

[51] Int. Cl.[7] ..... C22C 38/40

[52] U.S. Cl. ..... 148/325; 148/327; 420/41; 420/49; 420/52; 420/57; 428/606

[58] Field of Search ..... 420/41, 43, 44, 420/49, 52, 56–58; 148/325, 327, 403; 428/606

[56] References Cited

U.S. PATENT DOCUMENTS 5,314,549 5/1994 Misao et al. .

FOREIGN PATENT DOCUMENTS 0 567 365 10/1993 European Pat. Off. .
0 738 783 10/1996 European Pat. Off. .
2 456 785 12/1980 France .

OTHER PUBLICATIONS

Patent Abstracts of Japan; "Stainless Steel Material Excellent in Wire Drawability"; vol. 96, No. 007, Jul. 31, 1996 & JP 08060308 (Daido Steel Co. Ltd.); Mar. 5, 1996.

*Primary Examiner*—Deborah Yee
*Attorney, Agent, or Firm*—Oblon, Spivak, McClelland, Maier & Neustadt, P.C.

[57] ABSTRACT

Austenitic stainless steel for the production of wire, which can be used in the field of drawing wire down to diameters of less than 0.3 mm and in the field of producing components subjected to fatigue, characterized by the following composition by weight:

$5\times10^{-3}\% \leqq \text{carbon} \leqq 200\times10^{-3}\%$ $5\times10^{-3}\% \leqq \text{nitrogen} \leqq 400\times10^{-3}\%$ $0.2\% \leqq \text{manganese} \leqq 10\%$ $12\% \leqq \text{chromium} \leqq 23\%$ $0.1\% \leqq \text{nickel} \leqq 17\%$ $0.1\% \leqq \text{silicon} \leqq 2\%$, in which the residual elements are controlled so as to obtain inclusions of oxides in the form of a glassy mixture, the proportions by weight of which are as follows:

$40\% \leqq SiO_2 \leqq 60\%$ $5\% \leqq MnO \leqq 50\%$ $1\% \leqq CaO \leqq 30\%$ $0\% \leqq MgO \leqq 4\%$ $5\% \leqq Al_2O_3 \leqq 25\%$ $0\% \leqq Cr_2O_3 \leqq 4\%$ $0\% \leqq TiO_2 \leqq 4\%$.

12 Claims, 1 Drawing Sheet

AUSTENITIC STAINLESS STEEL ESPECIALLY FOR MAKING WIRE

BACKGROUND OF THE INVENTION

1. Field of the Invention

The present invention relates to an austenitic stainless steel, especially for making wire, having an inclusion cleanliness for use in the field of drawing wire down to diameters of less than 0.3 mm and in the field of producing components subjected to fatigue.

2. Discussion of the Background

Iron alloys containing at least 10.5% chromium are referred to as stainless steels. Other elements form part of the composition of the steels so as to modify their structure and their properties.

Austenitic stainless steels have a defined composition. The austenitic structure forms after transformation by a heat treatment of the rapid cooling type.

From a metallurgical standpoint, it is known that certain alloying elements forming part of the composition of the steels favor the appearance of the ferrite phase, which has a metallographic structure of the body-centered cubic type. These elements are called alphagenic elements. Among these are chromium, molybdenum and silicon.

Other so-called gammagenic elements favor the appearance of the austenite phase, having a metallographic structure of the face-centered cubic type. Among these elements are carbon, nitrogen, manganese, copper and nickel.

In the field of wire drawing, for example, it is known that, in order to obtain a wire having a diameter of less than 0.3 mm, called fine wire, the stainless steel used must not have inclusions whose size causes the wire to break during drawing.

In the production of austenitic stainless steels, as for all other steels produced using conventional means economically suitable for mass production, the presence of inclusions of the sulfide or oxide type is routine and irremediable. This is because stainless steels, in the liquid state, may, because of the production processes, have oxygen and sulfur contents in solution of less than 1000 ppm. When cooling the steel in the liquid or solid state, the solubility of the oxygen and sulfur elements decreases and the energy of formation of oxides or sulfides is reached. Inclusions therefore appear, these being formed, on the one hand, from compounds of the oxide type containing oxygen atoms and alloying elements eager to react with oxygen, such as calcium, magnesium, aluminum, silicon, manganese and chromium, and, on the other hand, compounds of the sulfide type containing, sulfur atoms and alloying elements eager to react with sulfur, such as manganese, chromium, calcium and magnesium. Inclusions may also appear which are mixed compounds of the oxysulfide type.

The amount of oxygen contained in the stainless steel may be reduced by using powerful reducing agents, such as magnesium, aluminum, calcium, titanium or a combination of several of these, but these reducing agents all lead to the formation of inclusions rich in MgO, $Al_2O_3$, CaO or $TiO_2$, which are all in the form of crystallized refractories that are hard and cannot be deformed under the conditions of rolling the stainless steel. The presence of these inclusions causes problems, for example breakages in wire drawing, and fatigue fractures in products produced from the stainless steel.

Patent Application F 95 04 782 discloses the treatment of an austenitic stainless steel for the production of wire which can he used in the wire-drawing field and in the field of producing components subjected to fatigue.

It has been observed in general, depending on the various compositions, that the stainless steel described does not perform reliably both from the standpoint of the number of breakages during wire drawing and from the standpoint of fatigue behavior. In other words, the steel compositions described in the patent application of the prior art are not entirely satisfactory, especially because the inclusion field is defined much too broadly.

SUMMARY OF THE INVENTION

A closed region in the inclusion field, defined by ranges of specific residual element contents which ensure optimum and reliable performance, especially in wire drawing and in fatigue, has been identified.

OBJECTS OF THE INVENTION

One object of the invention is to produce an austenitic stainless steel having a selected inclusion cleanliness, which steel can be used especially in the field of drawing wire down to diameters of less than 0.3 mm and in the field of producing components subjected to fatigue.

DETAILED DESCRIPTION OF THE INVENTION

The subject of the invention is an austenitic stainless steel comprising, consisting essentially of and consisting of iron and having the following composition by weight:

$5\times10^{-3}\% \leqq \text{carbon} \leqq 200\times10^{-3}\%$ $5\times10^{-3}\% \leqq \text{nitrogen} \leqq 400\times10^{-3}\%$ $0.2\% \leqq \text{manganese} \leqq 10\%$ $12\% \leqq \text{chromium} \leqq 23\%$ $0.1\% \leqq \text{nickel} \leqq 17\%$ $0.1\% \leqq \text{silicon} \leqq 2\%$ in which the following elements are controlled so that:

$0\% \leqq \text{sulfur} \leqq 100\times10^{-4}\%$ $40\times10^{-4}\% \leqq \text{total oxygen} \leqq 120\times10^{-4}\%$ $0\% \leqq \text{aluminum} \leqq 5\times10^{-4}\%$ $0\% \leqq \text{magnesium} \leqq 0.5\times10^{-4}\%$ $0\% \leqq \text{calcium} \leqq 5\times10^{-4}\%$ $0\% \leqq \text{titanium} \leqq 4\times10^{-4}\%$ and in which oxide inclusions present have, in the form of a glassy mixture, the following proportions by weight:

$40\% \leqq SiO_2 \leqq 60\%$ $5\% \leqq MnO \leqq 50\%$ $1\% \leqq CaO \leqq 30\%$ $0\% \leqq MgO \leqq 4\%$ $5\% \leqq Al_2O_3 \leqq 25\%$ $0\% \leqq Cr_2O_3 \leqq 4\%$ $0\% \leqq TiO_2 \leqq 4\%$, the oxides of which the inclusions are composed satisfying the following relationship:

$$\%\ Cr_2O_3 + \%\ TiO_2 + \%\ MgO < 10\%.$$

Other preferred characteristics of the invention, which may be present individually or in any combination are:

the composition of the steel includes less than $50\times10^{-4}\%$ sulfur;

the composition of the steel includes less than 3% molybdenum;

the composition of the steel includes less than 4% copper.

BRIEF DESCRIPTION OF THE DRAWINGS

The description which follows, together with the appended figures, all given by way of nonlimiting example, will make the invention clearly understood.

Figure 1:
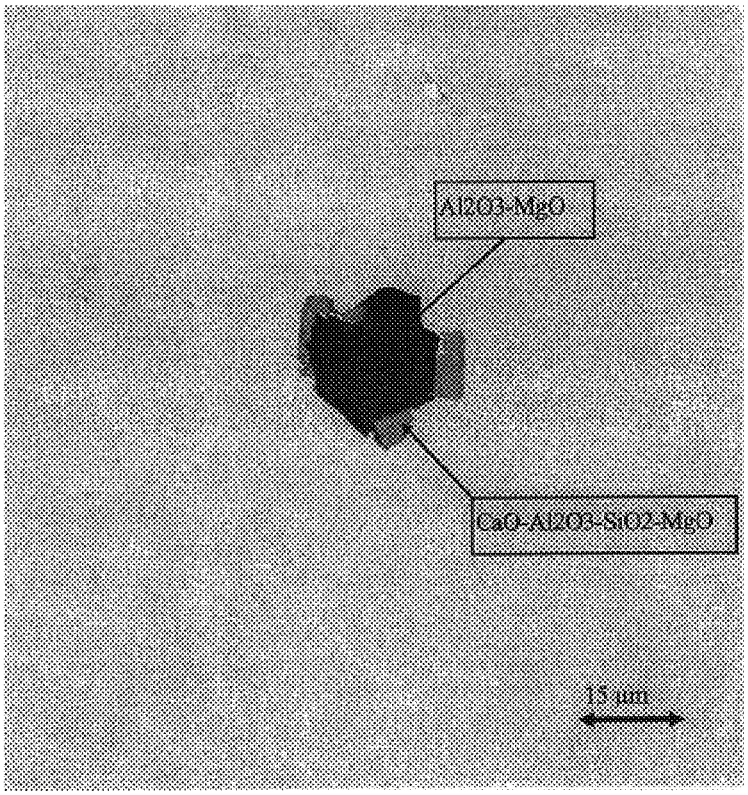
FIGS. 1 and 2 show, respectively, an image of an example of a thick and hardly deformed inclusion and an image of an example of inclusions contained in a steel according to the invention.

The steel according to the invention contains, in its composition by weight, iron and from $5\times10^{-3}$% to $200\times10^{-3}$% carbon, from $5\times10^{-3}$% to $400\times10^{-3}$% nitrogen, from 0.2% to 10% manganese, from 12% to 23% chromium, from 0.1% to 17% nickel, from 0.1% to 2% silicon and, in particular, residual elements controlled so that their composition by, weight is as follows: more than 0% to $100\times10^{-4}$% of sulfur, from $40\times10^{-4}$% to $120\times10^{-4}$% of total oxygen, more than 0% to $5\times10^{-4}$% of aluminum, from 0% to $0.5\times10^{-4}$% of magnesium, more than 0% to $5\times10^{-4}$% of calcium and from 0% to $4\times10^{-4}$% of titanium, impurities inherent in the manufacture, and in which oxide inclusions have, in the form of a glassy mixture, the following proportions by weight:

$40\% \leqq SiO_2 \leqq 60\%$ $5\% \leqq MnO \leqq 50\%$ $1\% \leqq CaO \leqq 30\%$ $0\% \leqq MgO \leqq 4\%$ $5\% \leqq Al_2O_3 \leqq 25\%$ $0\% \leqq Cr_2O_3 \leqq 4\%$ $0\% \leqq TiO_2 \leqq 4\%$, the oxides of which the inclusions are composed satisfying the following relationship:

$$\%\ Cr_2O_3 + \%\ TiO_2 + \%\ MgO < 10\%.$$

Carbon, nitrogen, chromium, nickel, manganese and silicon are the usual elements allowing an austenitic stainless steel to be obtained.

The manganese, chromium and sulfur contents, proportionally, are chosen in order to generate deformable sulfides of well-defined composition.

The compositional ranges for the elements silicon and manganese, proportionally, ensure, according to the invention, that inclusions of the silicate type, that are rich in $SiO_2$ and contain a non-negligible amount of MnO, are present.

Molybdenum may be added to the composition of the austenitic stainless steel with an amount preferably not more than 3% in order to improve the corrosion behavior.

Copper may also be added to the composition of the steel according to the invention as it improves the cold-deformation properties and, consequently, stabilizes the austenite. However, the copper content is preferably limited to 4% in order to avoid difficulties during hot conversion, as copper appreciably lowers the upper limit of temperatures to which the steel can be reheated before rolling.

The total-oxygen, aluminum and calcium ranges make it possible, according to the invention, to obtain inclusions of the manganese silicate type which contain a non-zero fraction of $Al_2O_3$ and of CaO. Both aluminum and calcium contained in the composition of the steel ensure, in the desired inclusions, that more than 1% of CaO and more than 5% of $Al_2O_3$ are present.

The values of the total-oxygen contents are, according to the invention, between 40 ppm and 120 ppm.

For a total-oxygen content of less than 40 ppm, oxygen fixes the elements magnesium, calcium and aluminum and does not form oxide inclusions rich in $SiO_2$ and MnO.

For a total-oxygen content of greater than 120 ppm, in the composition there will be oxides with more than 4% $Cr_2O_3$, which favors the crystallization that it is desired to avoid.

The calcium content is less than $5\times10^{-4}$% so that the desired inclusions do not contain more than 30% CaO.

The aluminum content is less than $5\times10^{-4}$% in order to prevent the desired inclusions from containing more than 25% $Al_2O_3$, which also favors undesirable crystallization.

It is conceivable, after having produced a steel containing inclusions of the oxide and sulfide type, using a conventional and economical process, to refine it in order to make these inclusions disappear by using slow and economically unprofitable remelting processes, such as vacuum remelting (vacuum argon remelting) or electroslag processes.

These remelting processes allow only partial elimination, by settling-out in the liquid pool, of the inclusions already present, without their nature and their composition being modified.

The invention relates to an austenitic stainless steel containing inclusions of an intentionally obtained chosen composition, the composition being in relation with the overall composition of the steel in such a way that the physical properties of these inclusions favor their deformation during hot transformation of the steel.

According to the invention, the austenitic stainless steel contains inclusions of defined composition which have their softening point close to the rolling temperature of the steel, these inclusions being such that the appearance of crystals harder than the steel at the rolling temperature, especially the following defined compounds: $SiO_2$ in the form of tridymite, cristobalite or quartz: $3CaO.SiO_2$; CaO; MgO; $Cr_2O_3$; anorthite, mullite, gehlenite, corundum or a spinel of the $Al_2O_3.MgO$ or $Al_2O_3.MnO.MgO$ type; $CaO.Al_2O_3$; $CaO.6Al_2O_3$; $CaO.2Al_2O_3$; $TiO_2$, is inhibited.

According to the invention, the steel contains mainly oxide inclusions of a composition such that they form a glassy or amorphous mixture during all the successive operations of forming the steel. The viscosity of the chosen inclusions is sufficient for the growth of the crystallized oxide particles in the resulting inclusions of the invention to be completely inhibited because, in an oxide inclusion, there is little short-range diffusion and convective movement is highly limited. These inclusions, which remain glassy in the temperature range for hot treatments of the steel, always have a lower hardness and a lower elastic modulus than crystallized inclusions of corresponding composition. Thus, the inclusions may be still deformed, compressed and elongated, for example during the wire-drawing operation, and any stress concentration near the inclusions is greatly reduced, thereby significantly reducing the risk of, for example, the appearance of fatigue cracks or the occurrence of breakages during wire drawing.

According to the invention, the austenitic stainless steel contains oxide inclusions of defined composition such that their viscosity in the range of temperatures at which the steel is hot rolled is not too high. Consequently, the yield stress of the inclusion is markedly lower than that of the steel under the hot-rolling conditions, the temperatures of which are generally between 800° C. and 1350° C. Thus, the oxide inclusions deform at the same time as the steel during hot rolling and therefore, after rolling, these inclusions are completely elongated and have a very small thickness, i.e. a thickness of less than 5 or 10 micrometers, therefore making it possible to avoid any breakage problem, for example during a wire-drawing operation.

According to the invention, the inclusions described above can be produced using the highly productive conventional production processes of an electric steel plant for stainless steels, such as an electric furnace, an AOD or VOD converter, in-ladle metallurgy and continuous casting.

With the conventional smelting and casting processes described above, the size distribution of the inclusions in the as-cast product is relatively independent of their composition. Therefore, before hot rolling, the steels contain the same sizes and the same distribution of inclusions.

The inclusions of the oxides below, which have the favorable properties described, are, according to the invention, composed of a glassy, mixture of $SiO_2$; MnO, CaO, $Al_2O_3$, MgO, $Cr_2O_3$, $TiO_2$ and, optionally, traces of FeO, in the following proportions by weight:

$40\% \leqq SiO_2 \leqq 60\%$ $5\% \leqq MnO \leqq 50\%$ $1\% \leqq CaO \leqq 30\%$ $0\% \leqq MgO \leqq 4\%$ $5\% \leqq Al_2O_3 \leqq 25\%$ $0\% \leqq Cr_2O_3 \leqq 4\%$ $0\% \leqq TiO_2 \leqq 4\%$.

If the $SiO_2$ content is less than 40%, the viscosity of the oxide inclusions is too low and the oxide-crystal growth mechanism is not inhibited. If the $SiO_2$ content is greater than 60%, very hard undesirable particles of silica in the form of tridymite or cristobalite or quartz are formed.

The MnO content, which is between 5% and 50%, allows the softening point of the oxide mixture in particular containing $SiO_2$, CaO, $Al_2O_3$ to be greatly reduced and favors the formation of inclusions which remain in a glassy state under the conditions in which the steel according to the invention is rolled.

When the CaO content is greater than 30%, crystals of $CaO.SiO_2$ or $(Ca,Mn)O.SiO_2$ are formed.

For an MgO content of greater than 4%, crystals of MgO; $2MgO.SiO_2$; $MgO.SiO_2$ or $Al_2O_3.MgO$ are formed, these being extremely hard phases.

If the $Al_2O_3$ content is less than 5%, crystals of wollastonite are formed and when the $Al_2O_3$ content is greater than 25%, crystals of mullite, anorthite, corundum, spinels, especially of the $Al_2O_3.MgO$ or $Al_2O_3.Cr_2O_3.MgO.MnO$ type, or else aluminates of the $CaO.6Al_2O_3$ or $CaO.2Al_2O_3$ or $CaO.Al_2O_3$ type, or gehlenite, appear.

With more than 4% $Cr_2O_3$, hard crystals of $Cr_2O_3$ or $Al_2O_3.Cr_2O_3.MgO.MnO$, $CaO.Cr_2O_3$, $MgO.Cr_2O_3$ also appear.

According to one form of the invention, the sulfur content must be less than or equal to $50\times10^{-4}\%$ in order to obtain sulfide inclusions having a thickness not exceeding 5 $\mu$m in the rolled product. This is because inclusions of the manganese sulfide and chromium sulfide type are completely deformable under the conditions of the invention.

In general, oxide- and sulfide-type inclusions are considered as being undesirable from the standpoint of use properties, in the case of fine-wire drawing and fatigue behavior, especially in flexure and/or in torsion. It is usual to characterize the concentration of oxide- and sulfide-type inclusions by examining a polished section in the rolling direction on a hot-rolled rod stock having a diameter of between 5 and 10 mm. The result of this characterization, carried out according to various standards depending on the final use, is called inclusion cleanliness.

For an inclusion observed in a polished section of rolled wire, its length and its thickness are measured and then a form factor, which is the ratio of the length to the thickness, is defined. For an inclusion which was very well deformed during the rolling operations, the form factor is generally very high, i.e. possibly reaching 100, and higher, and consequently the thickness of the inclusion is extremely small. On the other hand, an inclusion which does not deform or undergoes a small deformation is characterized by a small form factor, i.e. of the order of 1, and therefore the thickness of the inclusion remains high and of the same order of magnitude as the size of the original inclusion in the as-cast product. Consequently, in the rest of the description, the thickness of each inclusion observed in the rolled wire is adopted as a simple and effective characterization criterion with respect to the use properties of the rolled wire.

Figure 2:
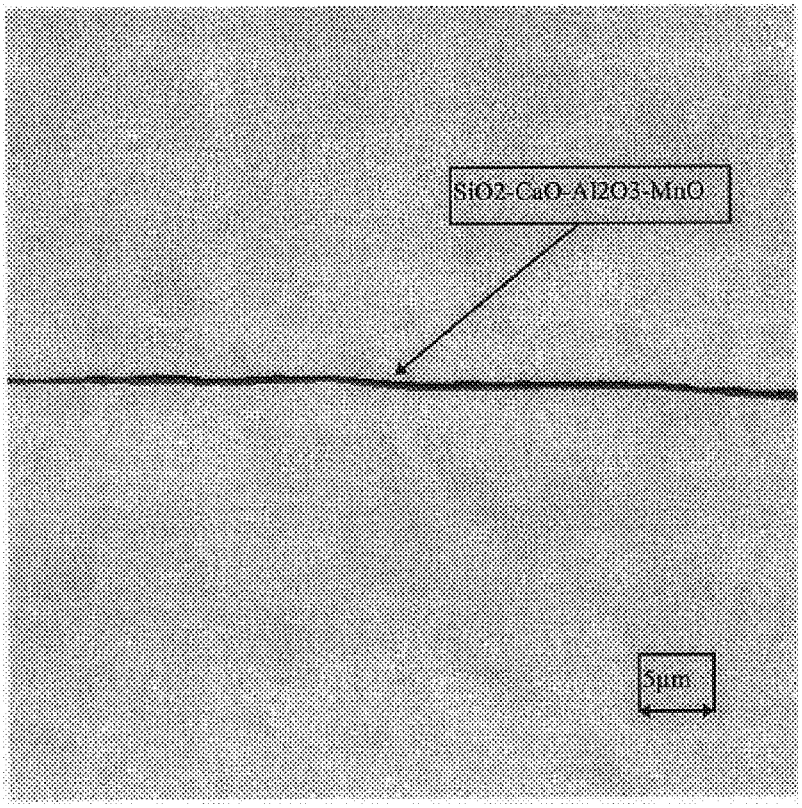

FIGS. 1 and 2 show, respectively, in a polished section in the machine direction of a rolled wire having a diameter of 5.5 mm, an example of a very thick and hardly deformed inclusions and an example of fine and very well deformed inclusions contained in the steel according to the invention.

FIG. 1 shows an example of a very thick and hardly deformed inclusion present in a rolled wire having a diameter of 5.5 mm.

FIG. 2 shows an example of a very well deformed inclusion present in a rolled wire having a diameter of 5.5 mm.

The latter inclusion is not harmful to fine-wire drawing operations for producing wire having a diameter of less than 0.3 mm or for components subjected to fatigue, such as springs or tire reinforcements.

It has been demonstrated that all compositions do not satisfy, in a reliable manner, the characteristics acceptable for wire production and for components subjected to fatigue. Depending on which composition is selected, both in terms of residual elements and in terms of the composition of the inclusions after the steel has been produced, inclusion quality criteria are defined.

Titanium, magnesium and sulfur are present in residual amounts and would be unable to be contained in the composition of the steel and, consequently, in the composition of the inclusions.

Tables 1 and 2 below show steels demonstrating the influence of the composition of the steel and of the composition of the oxide inclusions on the wire drawability and on the fatigue behavior. The following basic composition, called the working composition, was chosen:

| | |
|---|---|
| % C | 0.072 |
| % N | 0.052 |
| % Si | 0.771 |
| % Mn | 0.736 |
| % Cr | 18.522 |
| % Ni | 8.773 |
| % Mo | 0.210 |
| % Cu | 0.310 |

TABLE 1

| | 1 | 2 | 2 | 3 | 4 | 5 | 6 |
|---|---|---|---|---|---|---|---|
| STEEL | | | | | | | |
| $O_t$ ppm | 17 | 39 | 39 | 53 | 87 | 123 | 71 |
| Al ppm | 11 | 5 | 5 | 8 | 7 | 5 | 7 |
| Ca ppm | 4 | 7 | 7 | 6 | 8 | 1 | 2 |
| Mg ppm | 2 | 1 | 1 | 1 | 2 | 0.8 | 0.4 |
| Ti ppm | 4 | 8 | 8 | 7 | 45 | 2 | 38 |
| S ppm | 71 | 47 | 47 | 61 | 27 | 41 | 53 |
| nature of the inclusions | | | | | | | |
| % $SiO_2$ | 25.6 | 25.2 | | 29.1 | 18.6 | 47.4 | 9 |
| % CaO | 40.0 | 41.1 | | 23.1 | 8.7 | 1.2 | 2.9 |
| % MnO | 0.7 | | 2.5 | 7.4 | 8.8 | 32.3 | 6.7 |
| % $Al_2O_3$ | 21.1 | 28.1 | 71 | 27 | 8.1 | 7.2 | 8.8 |
| % MgO | 12.0 | 2.6 | 26.5 | 4.5 | 2.6 | 1.1 | 0.8 |
| % $Cr_2O_3$ | 0.1 | | | 1.6 | 6 | 8.7 | 7.5 |
| % $TiO_2$ | 0.5 | 3 | | 7.1 | 44.9 | 2.1 | 56.3 |

TABLE 2

| | 7 | 8 | 9 | 10 | 11 | 12 |
|---|---|---|---|---|---|---|
| STEEL | | | | | | |
| $O_t$ ppm | 71 | 95 | 53 | 113 | 43 | 68 |
| Al ppm | 4 | 5 | 3 | 5 | 3 | 3 |
| Ca ppm | 3 | 5 | 3 | 5 | 3 | 2 |
| Mg ppm | 0.3 | 0.4 | 0.3 | 0.5 | 0.2 | 0.2 |
| Ti ppm | 2 | 1 | 2 | 3 | 1 | 2 |
| S ppm | 13 | 33 | 24 | 38 | 21 | 45 |
| nature of the inclusions | | | | | | |
| % $SiO_2$ | 41.2 | 47.5 | 41 | 48.9 | 40.9 | 42.4 |
| % CaO | 14.1 | 10.1 | 25.6 | 7.5 | 29.2 | 10.4 |
| % MnO | 18.3 | 24.7 | 10.2 | 28.1 | 7.8 | 15.6 |
| % $Al_2O_3$ | 17.9 | 11.6 | 16.5 | 8 | 17.7 | 23.2 |
| % MgO | 1.7 | 1.0 | 3.1 | 0.6 | 2.5 | 1.6 |
| % $Cr_2O_3$ | 4 | 3.8 | 2 | 3.6 | 1.4 | 3.3 |
| % $TiO_2$ | 2.9 | 1.3 | 1.6 | 3.4 | 0.5 | 3.5 |

Table 1 shows steel compositions regarded as being of mediocre quality in terms of wire drawability and in terms of fatigue behaviour. Table 2 shows steel compositions according to the invention, which have an inclusion cleanliness that results in a remarkable quality in the two fields in question.

French patent application 98 03 263 is incorporated herein by reference.

What is claimed is:

1. An austenitic stainless steel comprising iron and the following elements by weight based on total weight:

$5\times10^{-3}\% \leqq \text{carbon} \leqq 200\times10^{-3}\%$ $5\times10^{-3}\% \leqq \text{nitrogen} \leqq 400\times10^{-3}\%$ $0.2\% \leqq \text{manganese} \leqq 10\%$ $12\% \leqq \text{chromium} \leqq 23\%$ $0.1\% \leqq \text{nickel} \leqq 17\%$ $0.1\% \leqq \text{silicon} \leqq 2\%$, wherein the weight of the following residual elements are controlled such that:

$0\% \leqq \text{sulfur} \leqq 100\times10^{-4}\%$ $40\times10^{-4}\% \leqq \text{total oxygen} \leqq 120\times10^{-4}\%$ $0\% < \text{aluminum} \leqq 5\times10^{-4}\%$ $0\% \leqq \text{magnesium} \leqq 0.5\times10^{-4}\%$ $0\% < \text{calcium} \leqq 5\times10^{-4}\%$ $0\% \leqq \text{titanium} \leqq 4\times10^{-4}\%$ and wherein oxide inclusions present comprise, in the form of a glassy mixture, the following oxides in proportions by weight based on total weight of glassy mixture:

$40\% \leqq SiO_2 \leqq 60\%$ $5\% \leqq MnO \leqq 50\%$ $1\% \leqq CaO \leqq 30\%$ $0\% \leqq MgO \leqq 4\%$ $5\% \leqq Al_2O_3 \leqq 25\%$ $0\% \leqq Cr_2O_3 \leqq 4\%$ $0\% \leqq TiO_2 \leqq 4\%$, the oxides of which the inclusions are composed satisfying the following relationship:

$$\%\ Cr_2O_3 + \%\ TiO_2 + \%\ MgO < 10\%.$$

2. The steel as claimed in claim 1, comprising less than $50\times10^{-4}\%$ sulfur.

3. The steel as claimed in claim 1, comprising less than 3% molybdenum.

4. The steel as claimed in claim 1, comprising less than 4% copper.

5. The steel of claim 1 in the form of a wire.

6. The steel of claim 2 in the form of a wire.

7. The steel of claim 3 in the form of a wire.

8. The steel of claim 4 in the form of a wire.

9. The steel of claim 5, wherein said wire has a diameter of less than 0.3 mm.

10. The steel of claim 6, wherein said wire has a diameter of less than 0.3 mm.

11. The steel of claim 7, wherein said wire has a diameter of less than 0.3 mm.

12. The steel of claim 8, wherein said wire has a diameter of less than 0.3 mm.

* * * * *